US006696976B1

(12) United States Patent
Hansen

(10) Patent No.: US 6,696,976 B1
(45) Date of Patent: Feb. 24, 2004

(54) VEHICLE WARNING SYSTEM

(76) Inventor: Jay A. Hansen, 6 W. Broad St., L'Anse, MI (US) 49946

( * ) Notice: Subject to any disclaimer, the term of this patent is extended or adjusted under 35 U.S.C. 154(b) by 0 days.

(21) Appl. No.: 10/201,096

(22) Filed: Jul. 23, 2002

(51) Int. Cl.[7] ..... G08G 1/00
(52) U.S. Cl. ..... 340/902; 340/901; 455/99; 455/209; 455/345
(58) Field of Search ..... 340/902, 901; 455/99, 209, 227, 345

(56) References Cited

U.S. PATENT DOCUMENTS

| | | | |
|---|---|---|---|
| 3,673,560 | A | 6/1972 | Barsh et al. |
| 3,760,349 | A | 9/1973 | Keister et al. |
| 3,772,641 | A | 11/1973 | Grosser et al. |
| 3,997,868 | A | 12/1976 | Ribnick et al. |
| 4,013,994 | A | 3/1977 | Ragano et al. |
| 4,238,778 | A | 12/1980 | Ohsumi |
| 4,403,208 | A | 9/1983 | Hodgson et al. |
| 4,764,978 | A | 8/1988 | Argo et al. |
| 4,887,086 | A | 12/1989 | Unser et al. |
| 5,303,259 | A | 4/1994 | Loveall |
| 5,559,508 | A | 9/1996 | Orr et al. |
| 5,594,432 | A | 1/1997 | Oliva et al. |
| 5,889,475 | A | 3/1999 | Klosinski et al. |

*Primary Examiner*—Julie Lieu
(74) *Attorney, Agent, or Firm*—Lynn E. Cargill; Mary H. Powell

(57) ABSTRACT

A vehicular warning system for use by school buses and/or other emergency vehicles in rural, hilly, areas and extremely low population areas, which provides a short range radio transmission signal broadcast sequentially over all 40 channels of a citizens band radio acting as an audible signal to be picked up by any nearby CB radio turned on. The warning system comprises a transmitter means to be installed on school buses and/or other emergency vehicles that can warn truck drivers of an upcoming situation which would require the truck to slow down or stop. The present system finds special utility in hilly regions where a truck driver cannot see over the next hill, and consequently does not know if he needs to stop.

5 Claims, 2 Drawing Sheets

VEHICLE WARNING SYSTEM

TECHNICAL FIELD

This invention relates generally to vehicle warning systems, and particularly relates to short range transmissions by emergency and school bus vehicles on receivable on all 40 channels of citizen band radios, generally found turned on in semi-trucks.

BACKGROUND OF THE INVENTION

In rural areas having small populations and hilly regions, winding narrow roads are the norm. They have speed limits of 55 mph and higher, and people tend to drive fast on these roads because they need to go long distances between towns. Due to the heavy weights of the trailers being towed, and the extra long braking distances required, semi-truck drivers and delivery truck drivers have difficulty stopping on a dime in the event of an emergency, or when a school bus in dropping off children, and all traffic must come to a stop. When a truck driver is climbing a hill, it would be difficult for him to bring his vehicle to a dead stop in the event of an emergency just over the hill. These occasions arise when emergency vehicles are parked and tending to cars along the side of the road or ambulances helping victims of traffic accidents. Furthermore, of special concern and interest to the present inventor, is the occurrence of school buses which have stopped to pick up or drop off children. When the children cross the road to go home, it is especially dangerous, because any semi-truck that must swerve to avoid a school bus stopped in the middle of the road would most certainly be in extreme risk of striking a child walking across the very pavement that the truck would have to go into in order to avoid the bus.

That is the most prevalent problem noticed by the present inventor. He finds especially when a school bus drops off a child, and that child has to cross the road, it is extremely dangerous if the drop off point is over a hill which carries truck traffic. Truck drivers find their biggest problem arises when they are traveling quickly down a road, coming over a hill, only to find that they have to slam on their brakes to avoid hitting a stopped school bus dropping off children. It is unpredictable where the school bus is stopped, as there are no road signs, nor are there any apparent stop signs to warn truck drivers about the impending danger.

Previously, there have been numerous attempts to produce a warning signal producing system for motor vehicle responsive to vehicle presence indicating radio wave signals emitted by another vehicle indicating its presence. However, the second vehicle, i.e. the one that needs to be warned, must have some sort of radio receiver which must be in the "On" position at all times in order to receive such a signal. Needless to say, there are many vehicles which have no radio, non-operational radios, or incompatible radios. Therefore, the problem of having all vehicles with perfectly compatible radio receivers is difficult to overcome.

In the closest known prior art attempt to solve this problem, a citizens band radio and/or receiver was utilized. Such an attempt was made in U.S. Pat. No. 4,013,994 issued to Ragano on Mar. 22, 1977, which discusses such a vehicular warning system, including the use of decoders and selectively filtered pre-selected signals. However, in direct contradistinction to the present invention, a single pre-selected signal is taught in the '994 patent. More recently, U.S. Pat. No. 4,403,208 issued to Hodgson, et al, on Sep. 6, 1983, relates to a warning signal producing apparatus for use in motor vehicles, also suffering from the same malady that a radio must be tuned and working for the signal to be received and coupled to a pre-existing audio stage piece of equipment.

Even more recently, U.S. Pat. No. 5,594,432 issued to Oliva, et al., on Jan. 14, 1997, for a traffic information warning system, includes a first and second oscillator for a first and second carrier frequency being reflective of a traffic situation. The receiver includes a scanning circuitry, in the form of a microprocessor, for scanning across a predetermined frequency range to detect carrier signals separated by the predetermined frequency difference, in addition to a demodulator for retrieving first and second modulating signals. The '432 receiver uses a microprocessor to compare the first and second modulating signals for identical status and then having an announcing device for announcing a message. This system is untenable in rural situations, and is not applicable to rural areas.

U.S. Pat. No. 4,238,778 issued to Ohsumi on Dec. 9, 1998, discloses a radio frequency radio signal which has an audible warning that increases as the distance between the emergency motor vehicle and the motor vehicle to be warned decreases. As the emergency motor vehicle approaches to within 100 meters of a vehicle equipped with the warning signal receiver of that patent, the warning signal is supposed to be detected by the receiver. However, this feature, again, would not work in a rural situation where more than 100 meters, i.e. just over 300 feet, would be needed. U.S. Pat. No. 4,887,086 issued to Unser, et al., on Dec. 12, 1989, discloses a combination citizen band scanner and radar detector, including a radio receiver for use in a vehicle which combines a radar receiver, a receiver for the citizen band and a scanning receiver for public service bands which are controlled by a microprocessor. The public service scanning receiver would cover a range of public service bands from 37 MHz to 470 MHz, while the receiver for the citizen band would cover frequencies from 26 MHz to 28 MHz. This does not cover all the stations on a CB radio. Therefore, it is of limited use.

Therefore, it is an object of the present invention to provide an inexpensive transmitter for use on school buses and emergency vehicles in rural applications which will be able to transmit a signal receivable on all 40 channels of a citizens band radio within a predetermined range, the range will depend on its use in the rural areas and very low population areas. It is widely accepted that truck drivers have their citizens band radio in the "On" position at all times, such that it would be able to receive a signal over any of the 40 channels on their citizens band radio.

It is also an object of the present invention to provide a 12-volt warning system so that it could be wired into all On and Off switches for the emergency or school bus vehicles.

It is yet a further object of the present invention to provide a device which only produces a signal, which would be much smaller with a minimal antenna and with no microphone to transmit voices.

It is yet a last object of the present invention to provide such a signal generator such that when a school bus or the like switches on its red flashing lights, the signal generator would begin to produce the signal.

SUMMARY OF THE INVENTION

In accordance with the objects and advantages as stated hereinabove, the present invention provides an inexpensive remote 40-channel signal generator to be installed on school buses, emergency vehicles, or the like. The signal is preferably a two tone signal which will be transmitted over any of the forty (40) channels on a citizens band radio, commonly found turned on in semi-trucks. The signal will only generate over a pre-selected relatively short distance range of from about 100 feet to about 2500 feet, depending upon the application in rural areas, or in extremely low population areas, so that trucks driving into a zone within a pre-selected distance can use their CB radios as receivers to receive a warning signal. The disclosed inexpensive signal generator would only produce a signal, would be much smaller than a regular CB radio with a minimal antenna, and with no microphone to transmit a voice. The device would run on a 12-volt system so that it could be wired into all On and Off switches for the vehicles, such that the system would be turned on automatically along with the school bus, emergency vehicle, railroad crossing, and the like.

The signal generator is an all channel CB tone transmitter to transmit a distinct signal over all the forty channels receivable by a standard citizens band radio. The range of the transmitter will be relatively short and will depend upon its use, whether it is to be used in the city or to be used in a rural area. The transmitter device would be made by utilizing a transmitter for a signal on all forty channels, much like a regular CB radio, only with a difference that this unit would only produce a signal, so it could but much smaller with a minimal antennae and without a microphone to transmit voice or other data signals. Preferably, a phase locked loop (PLL) tuner may be used to transmit on all FCC approved channels sequentially and automatically within several seconds. The required N-code input to the phase locked loop tuner is provided by a binary counter. An alternating two (2) tone audio signal may be mixed into the transmission before broadcasting.

DETAILED DESCRIPTION OF THE INVENTION

Figure 1:
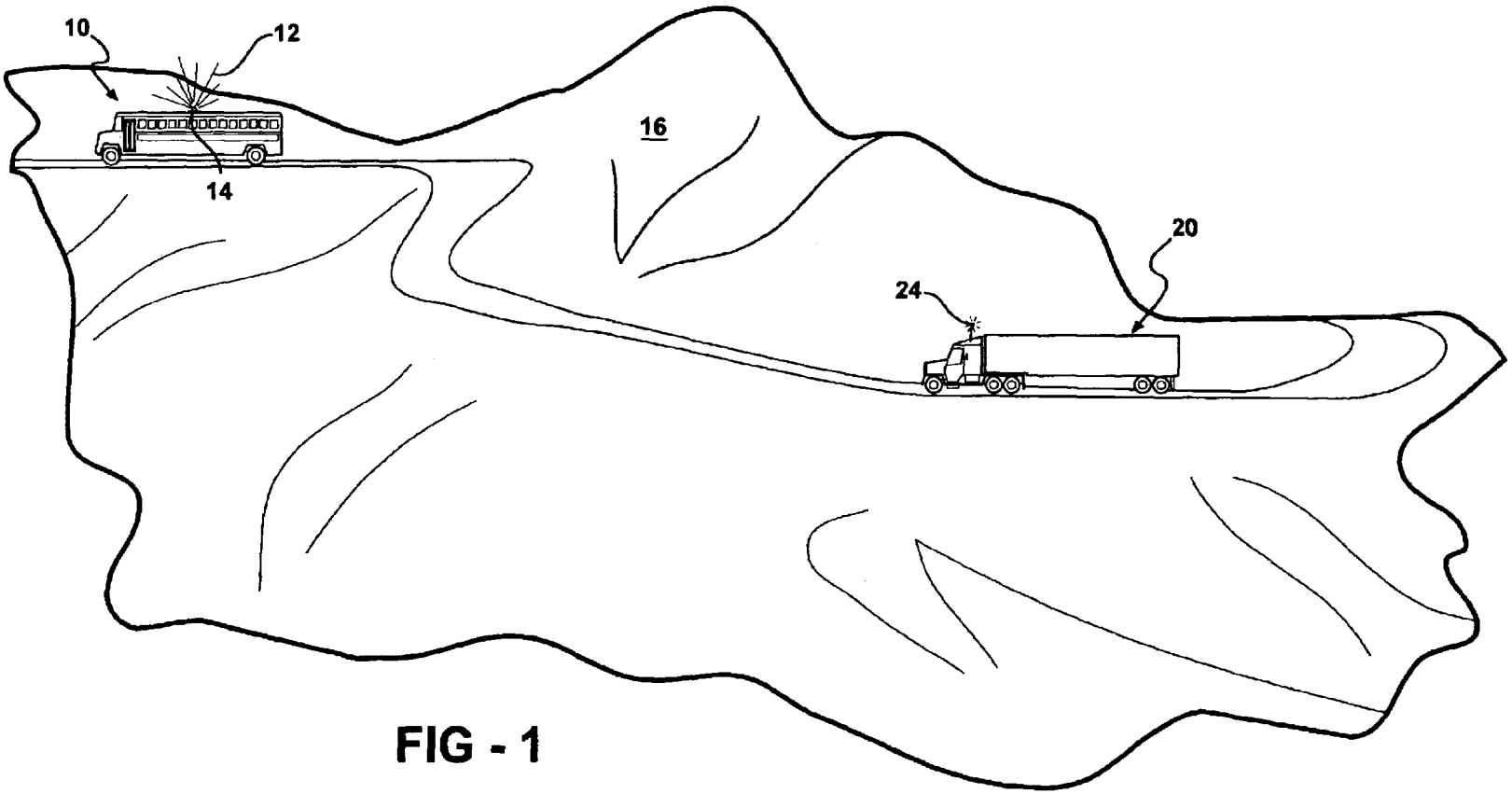
FIG. 1 is an illustration of the situation necessitating the present invention.

In accordance with these and other aspects of the invention, there is disclosed a vehicular warning system designed to transmit an audible signal, preferably a two-tone alarm-type signal, that will be received on a standard truckers' citizens band radio, across all forty channels, such as to provide a warning to semi-truck drivers when either a school bus is stopped in the road ahead of them or there is some form of emergency ahead. In the present invention, the school bus and/or emergency vehicle will carry a transmitter for transmitting and automatically creating an audible signal across all forty channels of the CB radios commonly used by semi-truck drivers. The bus will constantly transmit a warning signal, and any citizens band radio (which is usually turned on) will receive the signal and warn the semi-truck drivers so that they will become aware of such an emergency. The vehicular warning system will transmit a distinct signal over all forty channels of the citizens band radio, and will have a range depending on its use, whether in rural hilly areas, or rural flat areas. When the truck driver hears the audible signal, it will give him an indication that there is a situation ahead of him that he needs to slow down for.

By varying the signal produced by the transmitter, the signal can also be used on railroad tracks to let a truck driver know when a train is coming or an emergency vehicle, such as a police car, ambulance or fire truck. The present invention is different from prior art inventions as the present vehicular warning system only produces a signal, thereby allowing it to be much smaller with a minimal antenna and no microphone needed to transmit a voice. A signal transmitter is a very economical electronic component, and would be inexpensive to install on government vehicles including school buses, police cars, fire trucks and the like. The device is adapted for use with a 12-volt system, such that it can be wired into all on and off switches for various vehicles. For example, when a school bus switches on its red flashing lights, my vehicular warning transmitter will begin to produce a warning signal across all 40 channels automatically to be detected by semi-truck drivers.

Semi-truck drivers are especially in need of such a signal, because the sheer weight of their vehicle requires a much longer braking time and distance than regular vehicles, such as cars and light duty trucks. As one knows, all semi-truck drivers make a practice of leaving their CB radio in the "on" position while driving, in order to receive information from other truck drivers and official signal transmitters. Traditionally, the signals they receive include voices from a transmitter which utilizes a microphone to transmit the voice of an operator. However, the present invention will be fully operational with only the transmission of an audible signal. In the embodiment for use with railroad tracks, it is envisioned that the 12-volt system can be activated when the railroad track lights begin to flash, rendering the transmission for the production of the audible warning system.

A particular advantage of the present invention is that a very high percentage of semi-trucks already have citizens band radios installed in their trucks, as they are used for communicating with each other for road conditions or obstacles which they may encounter in their route. Therefore, such a warning system would not require the expenditure of an additional radio receiver for use within the truck. Once a truck driver is made aware of the device, and what the signal means, he will use it to give him an advantage to avoid possible accidents by becoming aware of potential obstructions in the road ahead before it becomes visible.

Referring next to the drawings, we look first to the situation rendering as shown in FIG.1, wherein a school bus is generally denoted by numeral 10, and a radio signal 12 is transmitted through transmitter antenna 14. School bus 10 is shown over hill 16, out of the view of the approaching semi-truck, as generally denoted by numeral 20. A transmitted radio signal 12 from school bus 10 is received by the CB radio antenna 24 on truck 20. This radio signal 12 is fed through a phase locked loop (PLL) tuner, as described more fully hereinbelow, and a binary/decade counter to tune all forty (40) of the FCC approved channels, in order, automatically. Therefore, all forty channels of the CB radio will receive the audible alarm signal to alert the semi-truck driver to alert him of an upcoming situation within from about 0.1 to about 2 miles, preferably about 0.5 miles in which he would have to put his brakes on. As stated above, school buses are not the only vehicle which are envisioned to utilize the present invention to transmit a radio signal 12. This invention is equally applicable to all emergency vehicles, including police cars, medical emergency vehicles, ambulances, fire trucks, and the like, as well as railroad track crossings and anything else which would the require the truck driver to slow down or stop in its vicinity.

Figure 2:
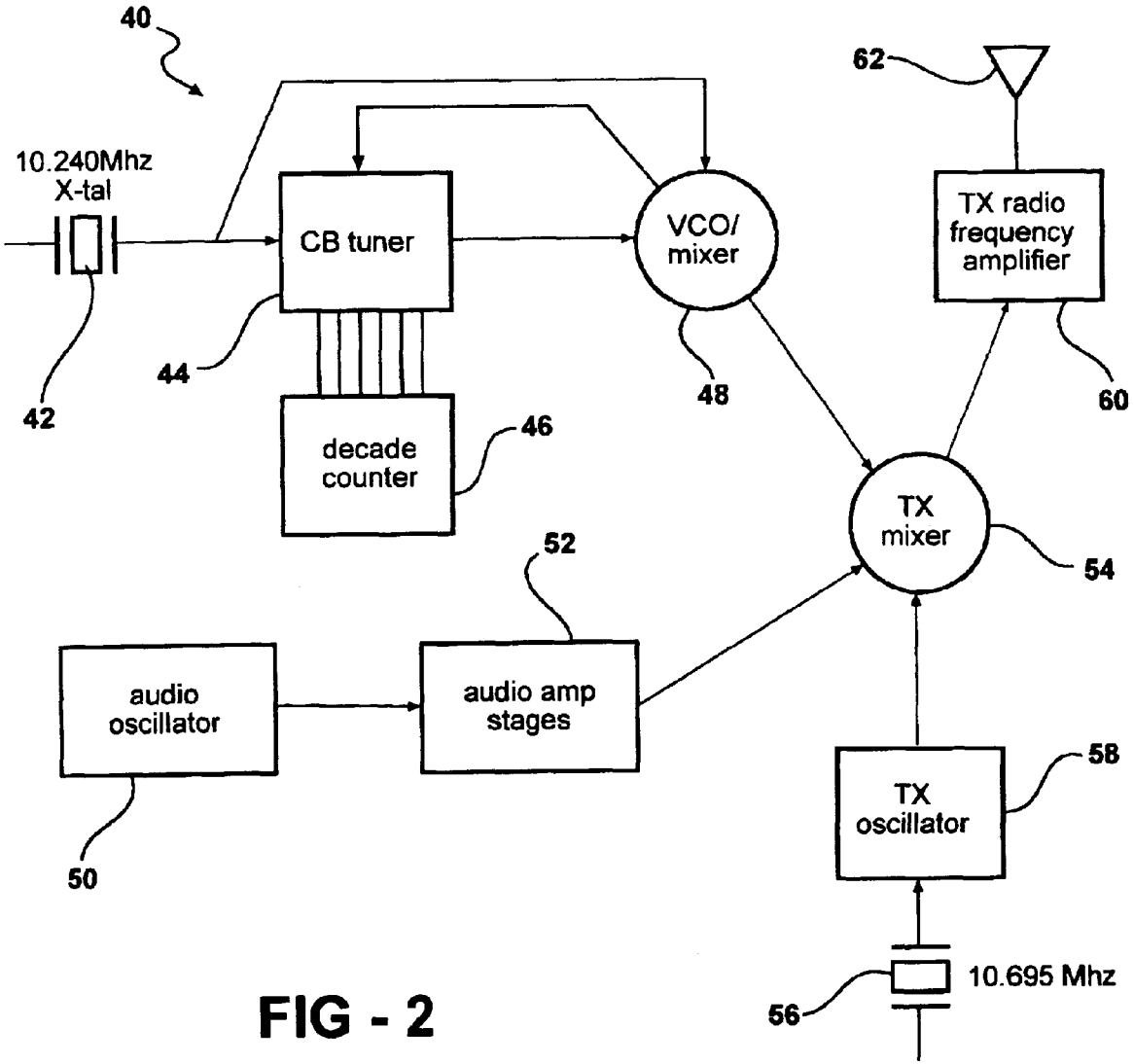
FIG. 2 is a schematic drawing of the vehicular warning system constructed in accordance with the present invention.

Looking next to FIG. 2, there is generally shown a vehicle warning system 40, including a stable crystal oscillator 42 in electrical communication with a citizens band radio tuner 44. The CB tuner 44 is in communication with a binary or decade counter 46 through select lines to act as a phase locked loop (PLL) tuner to tune all forty (40) FCC approved channels, in sequential order, automatically. All the approved citizen's band frequencies are automatically tuned in sequential order, within a very short time period, preferably on the order of a 2 second interval. The required N-Code input to the PLL tuner is provided by binary/decade counter 46. An alternating 2-tone audio signal is produced by an audio oscillator 50 which is amplified by audio amplifier stage 52 and is fed into a transmitter mixer/TX mixer 54. A combination signal of the CB frequency from a VCO mixer 48 and the audio signal from the audio oscillator 50 are supplied to an amplifier 52 and a transmitter 60 for broadcast on CB frequencies in a range of from about 0.5 to about 4 watts of output power. Audio oscillator 50 is used to generate a 2-tone or 2 frequency alternating data or signal which is then fed to the audio amp stages in order to amplify the signals to the proper levels for the TX mixer.

As is well known, the data signal rides on a carrier, and in the present invention, there will be forty unique carriers which correlate to various channels on the CB radio. TX oscillator 58 may be added directly into TX mixer 54, or the signal from the TX oscillator 58 may be initially mixed with the signal from VCO mixer 48. It is also envisioned that the signal from VCO mixer 48, the amplified signal from audio amp stages 52 and the transmitter signal from the TX oscillator 58 may all come together in the TX mixer 54 individually. Otherwise, it is foreseen that the VCO mixer 48 signal and that of the TX oscillator 58 can be combined together first before mixing with the amplified signal from the audio amp stages 52. Thereby, an alternating 2-tone audio signal is mixed into the transmission before broadcasting. The binary or decade counter 46 may include CB N-Codes of 330–286 in repeating cycles and/or frequencies.

It is preferred that the stable crystal oscillator 42 has a frequency of 10.240 MHZ. A second crystal oscillator 56 is in communication with the TX oscillator, and generates a signal which is fed into the TX mixer 54. Second crystal oscillator 56 preferably has includes a frequency of 10.695 MHZ.

Once the signals have been mixed in the TX mixer 54, the signal is fed into the transmitter radio frequency amplifier 60 which is then transmitted through antenna 62 to be received in the semi-trucks on their CB radios. Of course, all forty channels are used for transmission so that the semi-truck driver, regardless of what station he is tuned into, will receive a 2-tone audio signal within several seconds. This should allow ample time for the truck driver to react and to be able to brake before he comes near the "danger zone".

What is claimed is:

1. A vehicle warning system to be installed on school buses, police cars, railroad crossings and other emergency situations, comprising:

an emergency transmitter radio including an oscillator in communication with a citizens band radio tuner;

a decade counter with select lines for sequentially tuning all 40 FCC approved channels in a time frame of from about 0.5 to about 10 seconds;

a phase locked loop tuner for receiving required N-code inputs from the decade counter;

an audio oscillator for producing an audio signal;

a transmitter mixer for combining the signals from the citizens band radio tuner and the phase locked loop tuner; and an amplifier which transmits the mixed signal through an antenna, whereby all 40 channels of a standard CB radio will be transmitted over a short range of from about 0.1 to about 2 miles, such that any vehicle having a CB radio turned on will receive an audible signal warning of upcoming danger on whatever channel the CB radio is tuned to.

2. The system of claim 1, wherein the decade counter includes a binary counter.

3. The system of claim 1, wherein all 40 FCC approved channels are tuned within about 2 seconds.

4. The system of claim 1, wherein the audio signal transmitted includes distinctive alternating 2-tone audio signals.

5. The system of claim 1, wherein the transmitted range is from about 0.1 to about 0.5 miles.

* * * * *